United States Patent [19]

Sudol

[11] 3,946,779

[45] Mar. 30, 1976

[54] NAIL GUIDE

[75] Inventor: Daniel H. Sudol, Newark, N.J.

[73] Assignee: The Raymond Lee Organization, Inc., New York, N.Y. ; a part interest

[22] Filed: Oct. 29, 1974

[21] Appl. No.: 518,360

[52] U.S. Cl. ..... 145/46
[51] Int. Cl.[2] ..... B25C 3/00
[58] Field of Search ..... 145/46; D8/14, 71; 215/307

[56] References Cited

UNITED STATES PATENTS

| | | | |
|---|---|---|---|
| 337,905 | 3/1886 | Wheelock | 145/46 |
| 450,766 | 4/1891 | Crawford | 215/307 |
| 3,060,442 | 10/1962 | Tomek | 145/46 |
| 3,603,310 | 9/1971 | Mottin | 215/307 X |
| D26,638 | 2/1897 | Meier | D8/14 |

FOREIGN PATENTS OR APPLICATIONS

| | | | |
|---|---|---|---|
| 195,504 | 4/1923 | United Kingdom | 215/307 |
| 390,385 | 3/1923 | Germany | 145/46 |

*Primary Examiner*—Al Lawrence Smith
*Assistant Examiner*—J. T. Zatarga
*Attorney, Agent, or Firm*—Daniel Jay Tick

[57] ABSTRACT

A block of resilient material has a radial slot formed therein for gripping a nail and holding it in position during initial driving thereof into an object.

1 Claim, 5 Drawing Figures

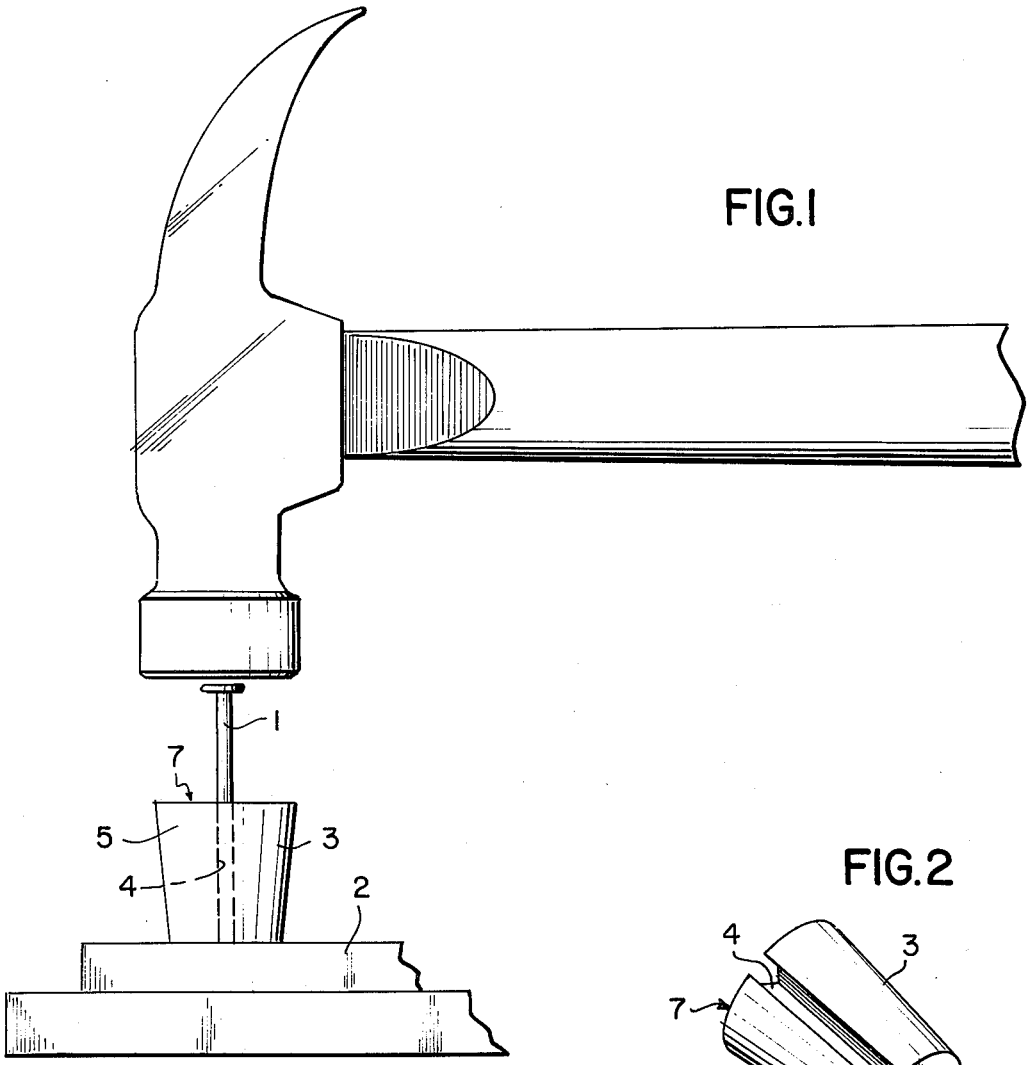
FIG.1
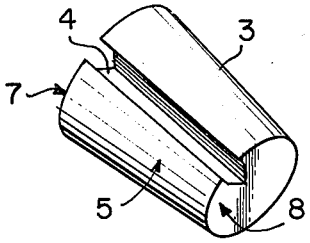
FIG.2
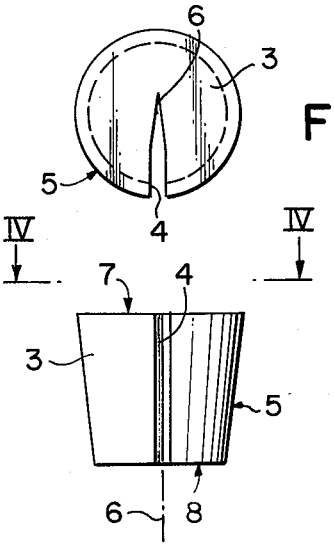
FIG.4
FIG.3
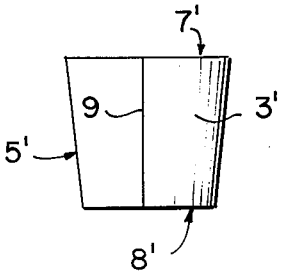
FIG.5

NAIL GUIDE

DESCRIPTION OF THE INVENTION

The present invention relates to a nail guide.

Objects of the invention are to provide a nail guide of simple structure, which is inexpensive in manufacture, used with facility and convenience by anyone, with or without skill, and functions efficiently, effectively and reliably to hold a nail in position during initial driving of the nail into an object.

In order that the invention may be readily carried into effect, it will now be disclosed with reference to the accompanying drawing, wherein:

FIG. 1 is a view of an embodiment of the nail guide of the invention in use;

FIG. 2 is a schematic diagram of the nail guide of the invention;

FIG. 3 is a side view of the embodiment of FIGS. 1 and 2;

FIG. 4 is a view, taken along the lines IV–IV, of FIG. 3; and

FIG. 5 is a side view of another embodiment of the nail guide of the invention.

In the FIGS., the same components are identified by the same reference numerals.

The nail guide of the invention holds a nail 1 (FIG. 1) in position during the initial driving of the nail into an object 2.

The nail guide of the invention comprises, as shown in FIGS. 1 to 4, a block 3 of substantially resilient material, such as, for example, rubber. A substantially radial slot 4 is formed in the block 3 for gripping a nail 1. The slot 4 extends from the outer surface 5 (FIG. 4) of the block 3 to the center 6 of said block (FIG. 4) and tapers downward toward said center, as shown in FIGS. 2, 3 and 4.

The block 3 is of substantially frustoconical configuration having a pair of spaced substantially planar substantially parallel bases 7 and 8 (FIGS. 2 and 3) and a substantially conical surface 5 between the bases. The slot 4 extends from substantially the axis or center 6 of the block 3 to the substantially conical surface 5 and tapers outward from said axis as it approaches said surface.

In the embodiment of FIG. 5, the block 3' is identical to the block 3 of the embodiment of FIGS. 1 to 4, except that the slot 4 is replaced by a cut 9.

While the invention has been described by means of specific examples and in specific embodiments, I do not wish to be limited thereto, for obvious modifications will occur to those skilled in the art without departing from the spirit and scope of the invention.

I claim:

1. A nail guide for holding a nail in position during initial driving of the nail into an object, said nail guide comprising a substantially frustoconical block of substantially resilient material having a pair of spaced substantially planar substantially parallel bases and a substantially conical surface between the bases, and a substantially radial slot formed therein for gripping a nail, said slot extending from substantially the axis of the block to the substantially conical surface and tapering outward from said axis as it approaches said surface.

* * * * *